US005165370A

United States Patent [19]

Beaumont

[11] Patent Number: 5,165,370

[45] Date of Patent: Nov. 24, 1992

[54] MECHANISM FOR CONTROLLING VALVE TIMING

[76] Inventor: Gerald Beaumont, 350 Spring Forest Dr., Simpsonville, S.C. 29681

[21] Appl. No.: 692,462

[22] Filed: Apr. 25, 1991

[51] Int. Cl.[5] ..... F01L 1/34

[52] U.S. Cl. ..... 123/90.16

[58] Field of Search ..... 123/90.15, 90.16, 90.39

[56] References Cited

U.S. PATENT DOCUMENTS

| | | | |
|---|---|---|---|
| 621,525 | 3/1899 | Hamilton | 123/76 |
| 3,911,879 | 10/1975 | Altmann | 123/90.16 |
| 4,138,973 | 2/1979 | Luria | 123/90.16 |
| 4,205,634 | 6/1980 | Tourtelot, Jr. | 123/90.16 |
| 4,382,428 | 5/1983 | Tourtelot, Jr. | 123/90.16 |
| 4,414,931 | 11/1983 | Burandt | 123/90.16 |
| 4,438,735 | 3/1984 | Burandt | 123/90.16 |
| 4,459,946 | 7/1984 | Burandt | 123/90.16 |
| 4,572,118 | 2/1986 | Baguena | 123/90.16 |
| 4,583,501 | 4/1986 | Williams | 123/90.16 |
| 4,911,124 | 3/1990 | Bennett | 123/90.16 |

FOREIGN PATENT DOCUMENTS

| | | |
|---|---|---|
| 3213565 | 10/1983 | Fed. Rep. of Germany . |
| 3406100 | 8/1985 | Fed. Rep. of Germany . |
| 889861 | 1/1944 | France . |
| 971641 | 1/1951 | France . |
| 320342 | 10/1929 | United Kingdom . |
| 1496513 | 12/1977 | United Kingdom . |
| 2144176 | 2/1985 | United Kingdom . |

*Primary Examiner*—E. Rollins Cross
*Assistant Examiner*—Weilun Lo
*Attorney, Agent, or Firm*—Jansson & Shupe, Ltd.

[57] ABSTRACT

The invention is an improvement upon an engine valve operating mechanism having a cam with a rotational axis and a lobe high point, a movable control surface and a cam follower. In the improvement, the follower has a cam-contacting face and the movable control surface is defined by boundaries maintained to one side of a plane. The plane is generally normal to the cam-contacting face and includes the cam rotational axis. Movement of the control surface varies the time of valve opening and/or closing without increasing the dimension to which such valve is opened. The control surface may be formed on an "insert" (a separate control member which is an adjunct to the conventional valve train components) or as an integral part of the cam follower. In event of a failure involving the insert or follower, the mechanism is fail-safe. The insert or follower may be made of a metal composite material for low inertia and good wear and strength characteristics.

6 Claims, 5 Drawing Sheets

MECHANISM FOR CONTROLLING VALVE TIMING

FIELD OF THE INVENTION

This invention relates generally to internal combustion engines and, more particularly, to mechanisms used in such engines to control valve timing.

BACKGROUND OF THE INVENTION

Conventional internal combustion engines are constructed so that the engine crank shaft, pistons, valve cam shaft and valves are linked together mechanically. In such engines, valve opening and closing is "timed" with respect to the position of the piston with which the valve is associated.

Timing of a valve is by a somewhat teardrop-shaped cam mounted on a rotating cam shaft. That portion of the cam protruding outward from the otherwise-circular shape of the cam is called the cam lobe. The lobe is that portion of the cam which directly or indirectly opens a valve once for each cam revolution. As the cam rotates, valve closure is by a compressed spring. Absent a control arrangement (and very simplistically), valve timing can be modified in either or both of two ways—and both require engine disassembly. One is by substituting a cam with another having a differently-shaped lobe. Another is by repositioning the cam on its axis of rotation so the lobe opens the valve earlier or later than normal.

So-called "normal" valve timing is generally satisfactory over a relatively wide range of speed and load operating conditions. Nevertheless, it is a compromise for many engine operating conditions. Stated another way, the ability to control timing helps optimize performance under such conditions. Such timing control may make possible improved efficiency, higher torque, reduced fuel consumption and reduced emissions.

In view of the prospective advantages, designers in this field have configured arrangements for changing valve timing while the engine is running. Examples of such arrangements are shown in UK Patent Application 2 144 176 (Doorbar); U.S. Pat. No. 4,205,634 (Tourtelot, Jr.); German Patent Document DE 3406100 (Roth) and UK Patent Specification 1 496 513 (Scarrot).

The arrangement shown in the Doorbar UK patent document involves planar or contoured inserts introduced between the cam and the cam follower. Such inserts are said to change both timing and lifting pattern, i.e., the distance to which a valve opens.

The arrangement shown in the Tourtelot, Jr. patent involves a movable wedge inserted between the valve tappet and the lobes of two cams. Using such arrangement, the time at which a valve starts to open can be varied as a function of the instantaneous position of the piston and crank shaft. However, the distance to which the valve opens must also change since the thickness of material interposed between a cam lobe and the valve tappet varies with changes in wedge position. To put it another way, there can be operating conditions where a cam lobe does not contact the top surface of the tappet during an entire cam revolution.

The Roth patent document shows a movable insert having a control surface used to affect the time at which a valve opens. The component on which the control surface is formed is movable toward and away from the cam by a crank-like actuator. In the illustrated arrangement, the insert may depress the tappet eccentrically rather then concentrically. FIG. 2 shows such eccentricity in that the projection from the bottom of the insert is not coincident with the valve centerline.

And the intermediate position of the insert shown in FIG. 2 (the crank-like mechanism is at neither extreme of travel) suggests there are at least some positions of such insert where the valve may be opened farther than normal rather than merely earlier or later than normal. In other words, if the insert is moved to its extreme right position, the thickness of the insert at the valve centerline is increased and the distance of valve opening will be increased.

The arrangement shown in the Scarrot patent document involves what is called an interposer, i.e., a component to modify valve timing. Such interposer is positioned by a relatively complex eccentric crank mechanism and is said to provide independent control of valve opening and closing times.

As explained, arrangements like those shown in the Tourtelot Jr. and Doorbar patent documents affect the dimension to which a valve is opened. Protrusion of the valve head further into the piston chamber and further compression of the valve spring beyond that occurring during normal timing can present two problems. One is that the protruding valve head may be struck by the piston. If this occurs, damage to the piston and/or the valve is virtually certain. And the increased area of opening between the valve head and the engine block may cause a modification in the fuel/air charge introduced into the piston chamber.

Excessive compression could unduly stress the spring and bring on premature spring failure. And if the spring is compressed to its solid height, other parts in the valve train could be damaged.

In those and other known arrangements, no provision is made to bring the control insert to a "home" position in event of failure of an aspect of the control system. Absent such provision, the insert may come to a random position which may or may not be acceptable for the then-prevailing engine operating condition. Worse is the possibility that the insert may come to position at which the engine will not run at all under normal operating conditions.

Yet another disadvantage of known arrangement is that valve operating and control components are made (or are apparently made) of steel formulated for such applications. Such steel is relatively heavy and has significant inertia, a factor in setting the maximum speed of engine operation.

OBJECTS OF THE INVENTION

It is an object of this invention to overcome some of the problems and shortcomings of the prior art.

Another object of this invention is to provide an improved mechanism for controlling valve timing wherein the dimension to which a valve is opened is not increased.

Another object of this invention is to provide an improved mechanism for controlling valve timing wherein such timing may be modified while yet avoiding eccentric loading of the valve stem.

Still another object of this invention is to provide an improved mechanism for controlling valve timing wherein the mechanism is fail safe.

Another object of this invention is to provide an improved mechanism for controlling valve timing wherein the mechanism components have reduced mass and, therefore, reduced inertia.

These and other important objects will be apparent from the descriptions of this invention which follow.

SUMMARY OF THE INVENTION

The invention is an improvement upon an engine valve operating mechanism having a cam with a rotational axis and a lobe high point, a movable control surface and a cam follower. In conventional arrangements, the cam follower is the "interface" between the cam lobe and the valve stem. To put it another way, the follower is interposed between the lobe and the valve stem and causes reciprocal stem movement as the cam rotates. Conventional cam followers exhibit similar reciprocating movement but are incapable of, e.g., linear movement.

In the improvement, the follower has a cam-contacting face and the movable control surface is defined by boundaries maintained to one side of a plane. The plane is generally normal to the cam-contacting face and includes the cam rotational axis. Movement of the control surface varies the time of valve opening without increasing the dimension to which such valve is opened.

In one preferred embodiment, the control surface is formed on what may be termed an "insert," i.e., a separate control member which is an adjunct to the conventional valve train components. Such insert is mounted for movement with respect to the cam for either advancing or retarding the time of valve opening, depending upon the configuration of the control surface. In another preferred embodiment, the control surface is formed as an integral part of a follower mounted for movement along an axis generally normal to the described plane. Such movement of the follower advances or retards the time of valve opening, depending upon the configuration of the control surface.

In a highly preferred embodiment and irrespective of whether the control surface is on the insert or on the cam follower, such insert or follower (as the case may be) is biased away from the cam along that axis generally normal to the described plane. A control force is applied to the insert or follower and opposes and overcomes the bias force to effect changes in valve timing. However, if there is a failure involving the mechanism used to provide the control force, the insert or follower is biased "away" from the cam position. In that way, the improved mechanism is made fail-safe.

In yet another preferred embodiment, the improvement includes a second movable control surface whereby the time of valve opening may be advanced by one control surface or retarded by the second control surface. Preferably, both control surfaces are formed as an integral part of a follower mounted for movement generally normal to the described plane. With such configuration, the bias force urges the follower to a "neutral" position wherein valve timing is neither advanced nor retarded from normal. Similar to the mechanism described above, application of a control force in an appropriate direction overcomes the bias force to advance or retard valve timing. But in event of a failure involving the mechanism used to provide control force, the follower moves to the neutral position and the mechanism is fail-safe.

In all embodiments, the insert or follower, as the case may be, are preferably made of a metal composite material having a weight per unit volume significantly less than that of steel. The mass of such parts is thereby reduced. A reduction in mass lowers the inertia of the mechanism and provides faster response. Such response becomes of greater importance with higher engine speeds. In fact, the use of lowered-inertia parts may increase the upper limit of engine speed and permit extraction of incrementally higher horsepower from such engine. Suitable metal composite materials include aluminum or magnesium embedded with silicon carbide or silicon nitride fibers or particles. Such metal composite materials have physical properties similar to those of steel but yet (for parts of equivalent size and shape) have significantly reduced mass.

Further details of the invention are set forth in the detailed description.

DETAILED DESCRIPTION OF PREFERRED EMBODIMENTS

Figure 7:
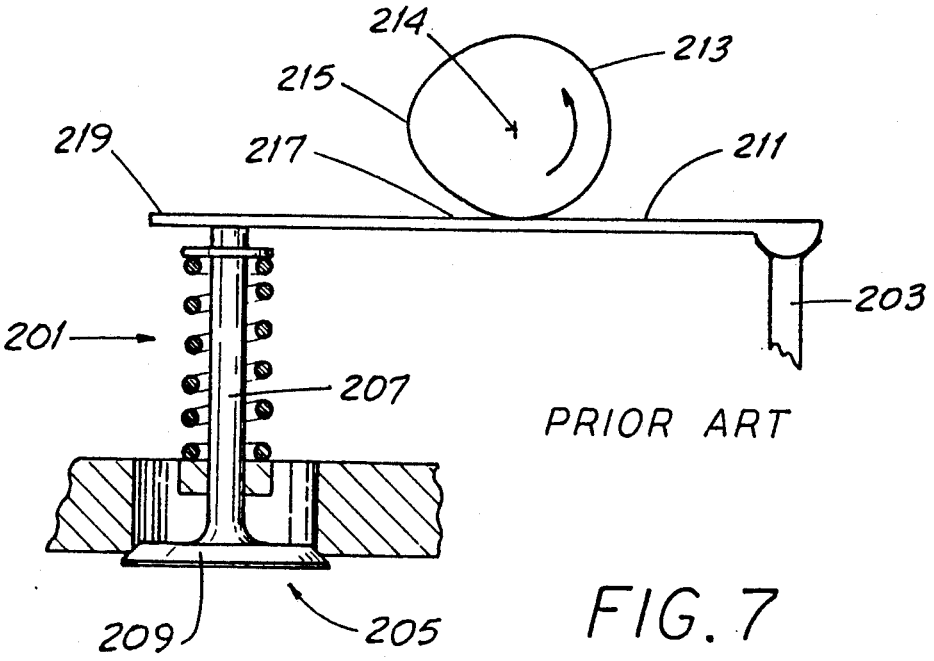
FIG. 7 is a side elevation view, with parts broken away, of a conventional valve train with the cam in a position such that the valve is closed.
Figure 8:
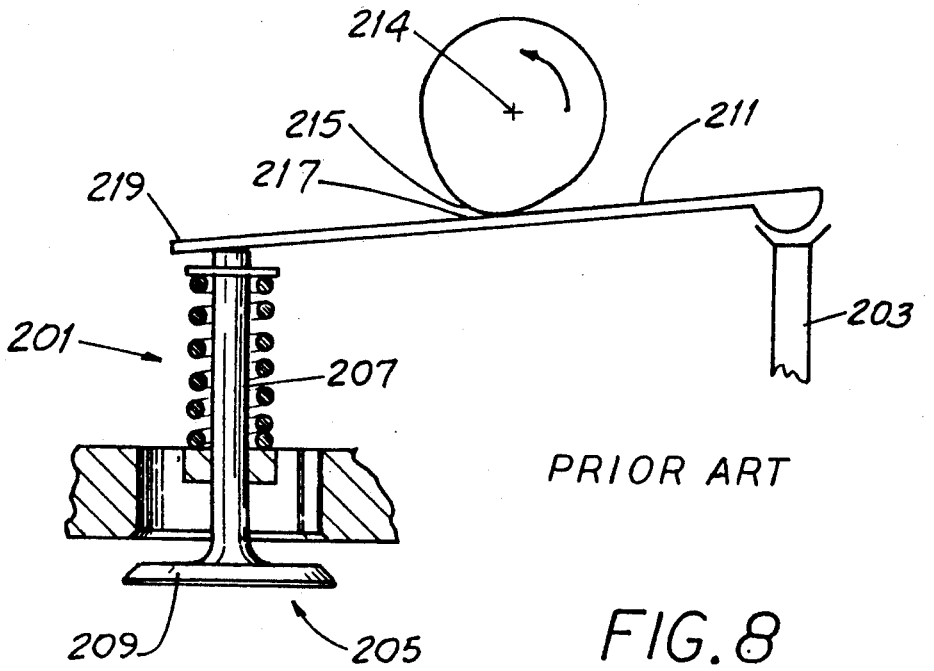
FIG. 8 is a side elevation view generally like that of FIG. 7 with the cam in a position to open the valve.

It is to be appreciated that the FIGURES are representations showing operating principles. Referring first to FIGS. 7 and 8, a conventional engine valve operating mechanism 201 (sometimes referred to as a valve train) includes a follower support 203, a valve 205 with stem 207 and valve head 209 and a cam follower 211 extending between the support 203 and the stem 207. The cam 213 rotates counter clockwise about an axis of rotation 214 and has a lobe 215 which bears against the cam-contacting face 217 of the follower 211 during a portion of each cam revolution. The lobe 215 urges the valve end 219 of such follower 211 downward, thus opening the valve 205. It is to be appreciated that the maximum opening of the valve 205, that referred to as "normal" herein, occurs when the lobe 215 is generally vertically downward in its sweep across the face 217.

Figure 1:
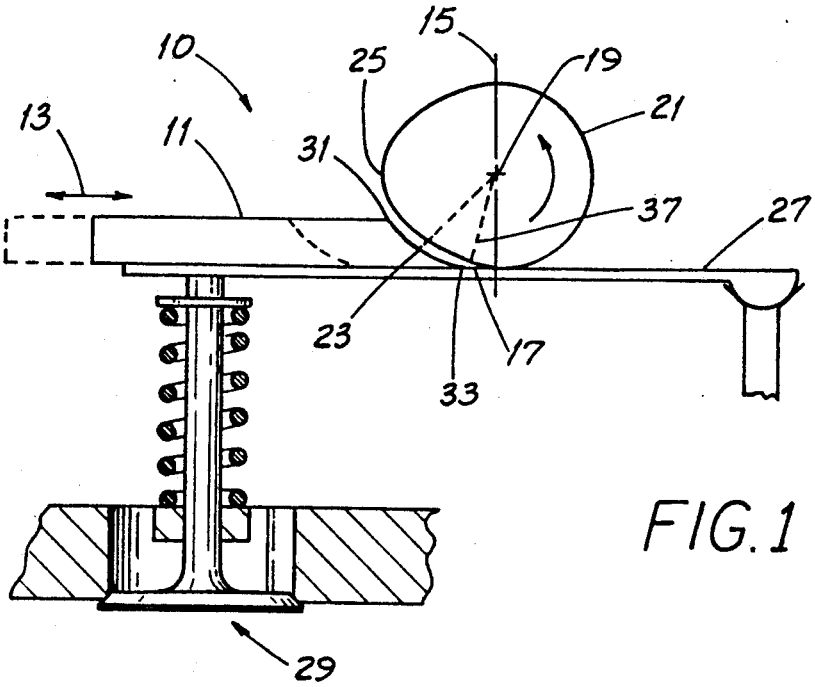
FIG. 1 is a side elevation view, with parts broken away, of a mechanism for advancing valve timing, with a position denoted in dotted outline, shown in conjunction with a valve train.
Figure 2:
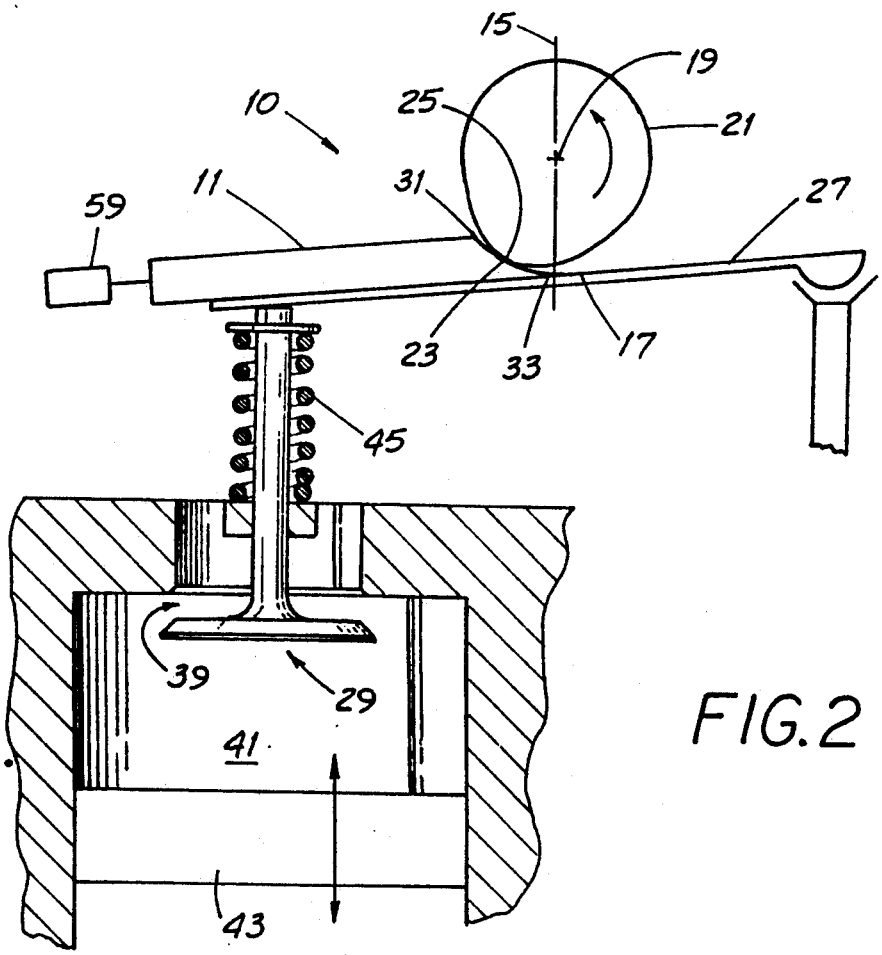
FIG. 2 is a side elevation view like that of FIG. 1 with the mechanism in a position to advance valve timing.

FIGS. 1 and 2 show an improved mechanism 10 for changing valve timing and more specifically, for advancing the time of opening a valve 29. The improved mechanism 10 includes a control insert 11 movable left and right generally parallel to the axis 13. For purposes of later explanation, a reference plane 15 is established generally normal to the cam-contacting face 17 and includes the axis of rotation 19 of the cam 21.

Such insert 11 has a control surface 23 formed thereon to be interposed between the cam lobe 25 and the cam-contacting face 17 of the follower 27 for changing the timing of the valve 29. In a highly preferred embodiment, such control surface 23 is curved and limited by an upper boundary 31 and a lower boundary 33. When the insert 11 is at an intermediate control position as shown in solid outline in FIG. 1, the lobe 25 contacts the surface 23 at a point generally coincident with the upper end of the "23" lead line. When the insert is fully withdrawn to a position shown in dotted outline in FIG. 1 (where it performs no control function), the lobe 25 contacts the face 17 at a point generally somewhat to the left of the upper end of the "17" lead line.

Referred to the plane 15, a line drawn through the axis of rotation 19 and the first-described point is at an angle slightly "in advance" of a line drawn between the axis of rotation 19 and the second-described point on the cam-contacting face 17. The relative positions of the dotted lines 35 and 37 is illustrative. From the foregoing, it will be seen that with the insert 11 and control surface 23 in the position shown in solid outline, the valve opens somewhat sooner than if the insert 11 had been entirely withdrawn. Valve timing is therefore said to be "advanced." FIG. 1 illustrates the cam 21, insert 11, follower 27 and valve 29 just prior to the valve 29 starting to open.

Referring particularly to FIG. 2, the valve 29 is shown fully opened and the position of the insert 11 is limited in the right hand direction such that the lower boundary 33 is maintained coincident with or to the left side of the reference plane 15. In any event, such lower boundary 33 does not extend to the right beyond the reference plane 15 for any control position of the insert 11. When the position of the insert 11 is so limited, the cam lobe 25 sweeps across the control surface 23 and as it comes to a generally downwardly vertical position, sweeps across at least a small portion of the cam-contacting face 17. Of course, whenever the lobe 25 is in contact with the face 17, the valve 29 may be opened no more than its normal opening dimension.

The effect of such arrangement is that while the valve 29 is opened sooner than it would have opened had the insert 11 been fully withdrawn, the dimension to which such valve 29 is opened does not increase beyond normal. This provides at least three important benefits.

One is that the valve 29 "aspirates" normally in that its annular opening 39 has the same flow area as exists when the insert 11 is fully withdrawn and the valve 29 is normally timed. Another is that the valve 29 is prevented from being extended further than normal into the piston chamber 41, thereby avoiding probably-damaging contact with the moving piston 43. Yet another is that the compressed valve spring 45 is never collapsed to its solid height nor, for that matter, to a height any less than that occurring in normal operation. Undue spring stresses or fractures are thereby avoided.

To summarize the depictions shown in FIGS. 1 and 2, when the insert 11 is fully withdrawn to the left (as in dotted outline in FIG. 1), its control surface 23 is never contacted by the cam lobe 25. The engine is then said to be operating under normal valve timing. As the insert 11 and its control surface 23 are moved progressively to the right as shown in FIGS. 1 and 2, the lobe 25 contacts the control surface 23 at points which become progressively closer to the upper boundary 31. The position of the insert 11 shown in solid outline in FIG. 1 shows what is termed an intermediate control position wherein the timing of opening the valve 29 is somewhat advanced.

When the insert 11 is at its fully extended position as shown in FIG. 2, timing of opening of the valve 29 is advanced to the maximum limit of the illustrated control mechanism 10. However, because the lobe 25 comes into contact with the face 17 during at least a small portion of each revolution of the cam 21, the dimension to which the valve 29 is opened is not increased beyond that which normally occurs. Contact of the lobe 25 and the face 17 is assured for each revolution of the cam 21 by limiting the rightward travel of the insert 11 so that its lower boundary 33 is coincident with the plane 15 or, more preferably, spaced very slightly left of the plane 15. To state it another way, the boundaries 31, 33 defining the control surface 23 are maintained to one side of the plane 15.

Figure 3:
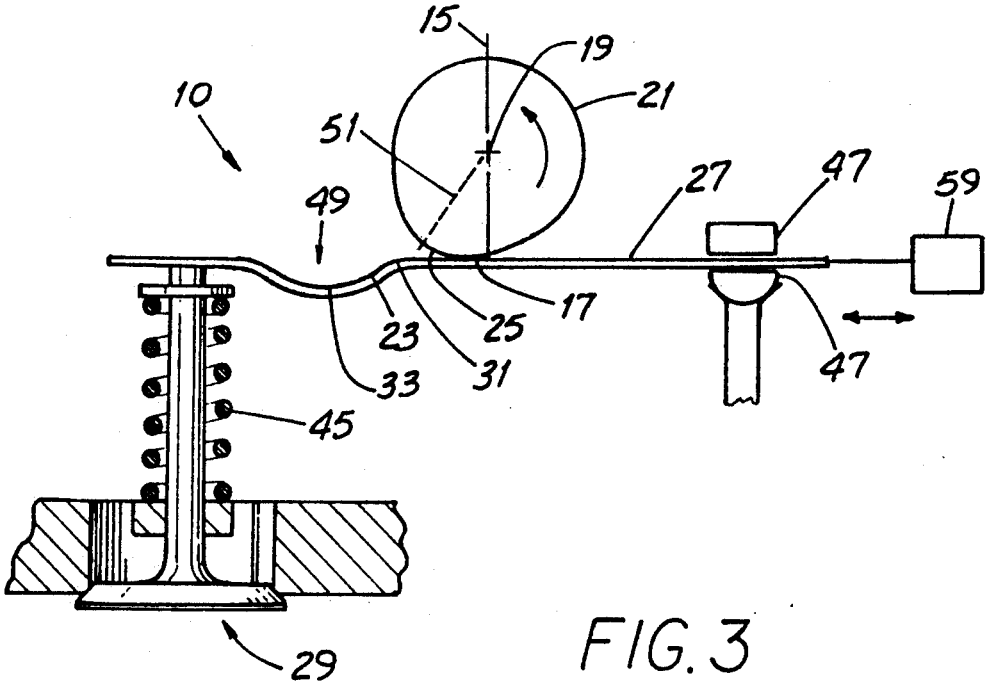
FIG. 3 is a side elevation view, with parts broken away, of a mechanism for retarding valve timing, shown in conjunction with a valve train.
Figure 4:
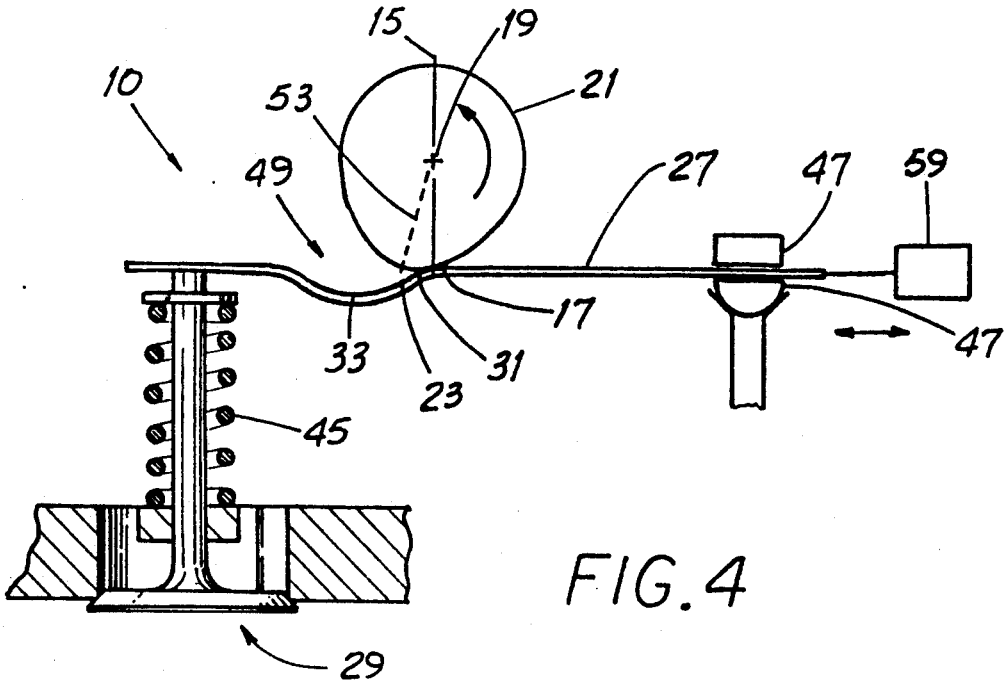
FIG. 4 is a side elevation view, with parts broken away, of the mechanism of FIG. 3 with the mechanism in a position to retard valve timing.

FIGS. 3 and 4 illustrate a mechanism 10 for retarding the time of valve opening. The cam follower 27 is mounted on supporting guides 47 for movement left and right. Such follower 27 has a cam-contacting face 17 and a control surface 23 defined by an upper boundary 31 and a lower boundary 33. FIG. 3 illustrates the instantaneous position at which the lobe 25 has contacted the face 17 and the valve 29 has just started to open. With the follower 27 positioned as shown, valve timing is normal.

Referring particularly to FIG. 4, the follower 27 is moved to a position somewhat to the right of that shown in FIG. 3. In such position, the depression 49 is positioned so that the cam lobe 25 starts to move the follower 27 at an angle of rotation later or "retarded from" that occurring in the arrangement of FIG. 3. This is illustrated by the relative angular positions of lines 51 and 53. In other words, interposition of the depression 49 in the path of the cam lobe 25 retards valve timing and the valve 29 opens somewhat later than normal. However, as with the arrangements shown in FIGS. 1 and 2, the cam lobe 25 sweeps across at least a small portion of the face 17 for each revolution of the cam 21. This assures that even though the valve 29 is opened somewhat later than normal, the dimension to which such valve is opened is not increased beyond normal.

FIG. 3 shows the approximate leftward limit of travel of the follower 27. Its travel to the right is limited such that the upper boundary 31 and the lower boundary 33 of the control surface 23 are preferably maintained to the left of the reference plane 15. As with the plane 15 shown in FIGS. 1 and 2, such plane 15 is generally normal to the follower 27 and includes the cam axis of rotation 19. When valve timing is retarded to the limiting capability of the mechanism 10, the upper boundary 31 may be coincident with such plane 15. In any event, such upper boundary 31 does not move to the right of such plane 15.

Figure 5:
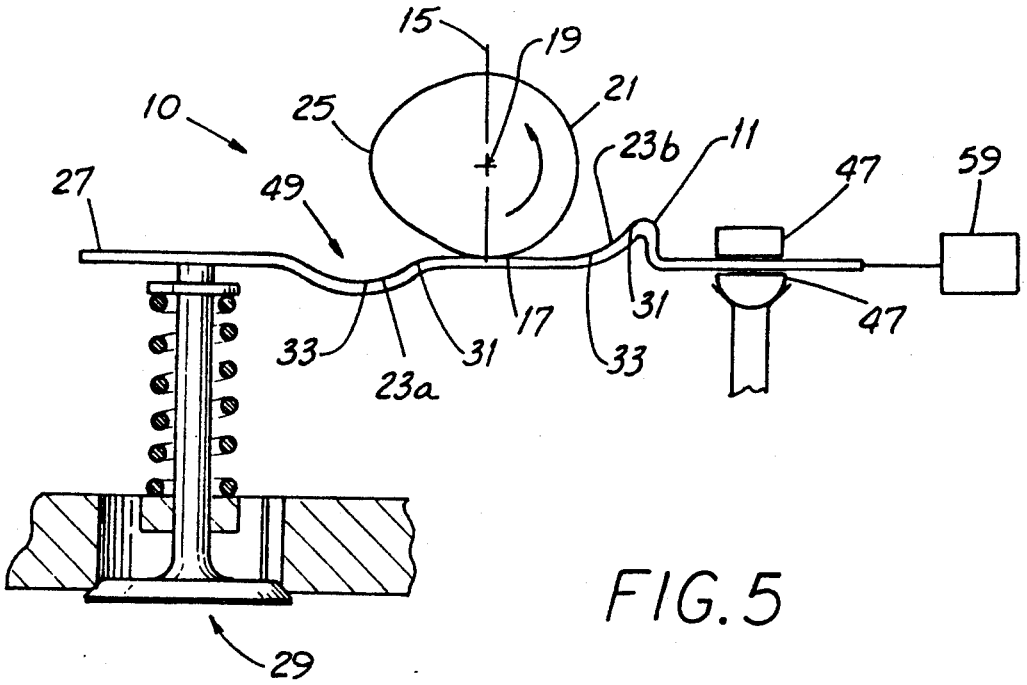
FIG. 5 is a side elevation view, with parts broken away, of one embodiment of a mechanism for retarding valve opening or closing.

Referring next to FIG. 5, another embodiment of the mechanism 10 includes a follower 27 mounted on guides 47 for sliding movement left and right. Such follower 27 includes both a depression 49 and a raised portion or "insert" 11, the latter preferably being an integral part of the follower 27. More specifically, when the follower 27 is positioned rightward from that shown in FIG. 5, the depression 49 is brought near the cam lobe 25 and the time of valve opening is retarded. When the follower 27 is moved leftward, the insert 11 is brought near the cam lobe 25 and the time of valve closing is retarded. In this multi-purpose arrangement, the upper and lower boundaries, 31 and 33, respectively, of the depression control surface 23*a* and the upper and lower boundaries, 31 and 33, respectively, of the raised control surface 23*b* are maintained to one side of a reference plane 15 generally normal to the face 17 and including the axis of rotation 19. The boundaries 31, 33 of the depression control surface 23*a* are maintained to the left thereof while those of the raised control surface 23*b* are maintained to the right thereof.

Figure 6:
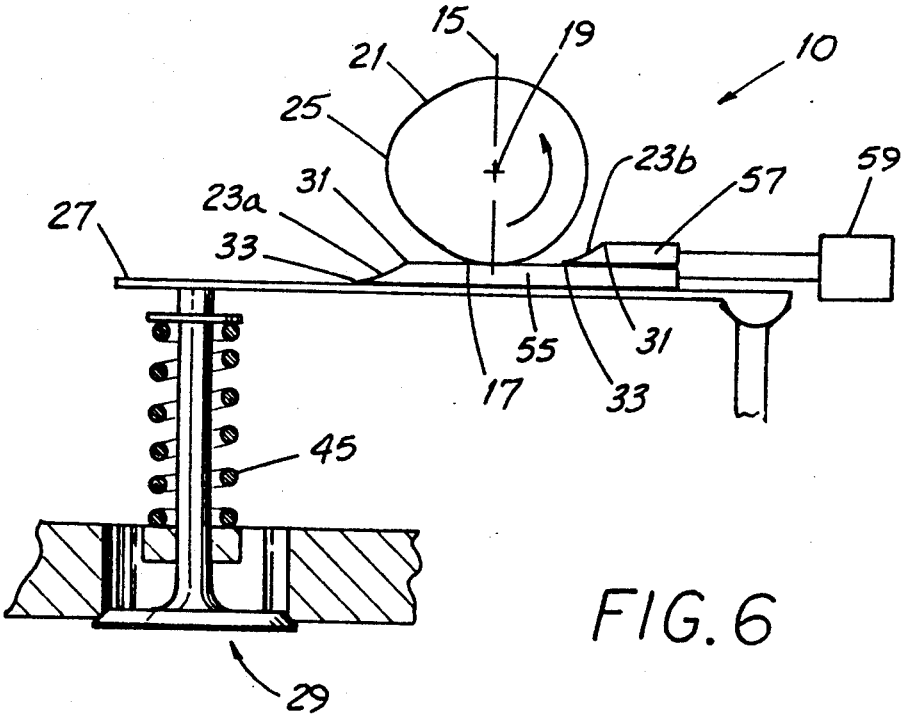
FIG. 6 is a side elevation view, with parts broken away, of another embodiment of a mechanism for retarding valve opening and closing.

In another multi-purpose embodiment of the mechanism 10 shown in FIG. 6, the cam follower 27 has a pair of control inserts 55, 57 including a first retarding insert 55 atop the upper surface of the follower 27. A second retarding insert 57 is "stacked" atop the insert 55 and that surface 23 bounded by the control surfaces 23*a*, 23*b* is the face 17 which contacts the cam lobe 25 during operation. A reference plane 15 is generally normal to the cam-contacting face 17 and includes the axis of rotation 19 of the cam 21.

The control surface 23*a* of the insert 55 is defined by an upper boundary 31 and a lower boundary 33 while the control surface 23*b* of the insert 57 is defined by an upper boundary 31 and a lower boundary 33. A control mechanism 59 is coupled to the inserts 55, 57 for moving such inserts generally left and right. If separate inserts 55, 57 are used, the control mechanism 59 may separately control the position of each or such inserts 55, 57 can be moved in unison. It is to be appreciated that the inserts 55, 57 may be formed as separate pieces separately movable (as shown and described above) or that they may be formed as a single movable composite insert. In the former instance (with separately controlled inserts 55, 57), retardation of valve opening and closing can be independently controlled.

During "normal" valve timing, the surfaces 23*a*, 23*b* are spaced from the plane 15 and the cam lobe 25 contacts only the face 17. When the opening of the valve 29 is retarded, the control surface 23*a* is moved rightward so that the lobe 25 contacts such surface 23*a* during a portion of each revolution. However, since the upper boundary 31 is not permitted to extend to the right of the plane 15 (and is preferably maintained at least slightly to the left thereof), the lobe 25 contacts the face 17 during at least a portion of each cam revolution. This assures that the maximum dimension to which the valve 29 is opened will be no more than normal.

When the closing of the valve 29 is retarded, the control surface 23*b* is moved leftward to permit lobe contact therewith during a portion of each revolution. However, the lower boundary 33 of such surface is not permitted to extend to the left of the plane 15 (and is preferably maintained at least slightly to the right thereof), the lobe 25 contacts the face 17 during at least a portion of each cam revolution. This likewise assures that the maximum dimension to which the valve 29 is opened will be no more than normal.

Figure 9:
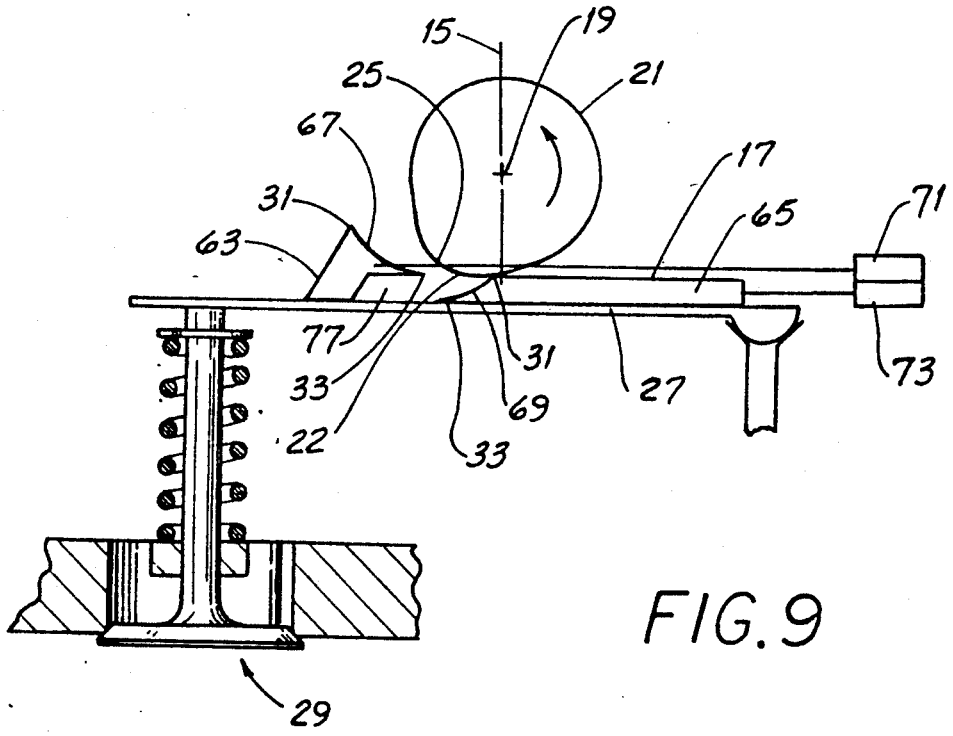
FIG. 9 is a side elevation view, with parts broken away, of an embodiment of a mechanism for advancing or retarding valve timing.

Yet another embodiment of the mechanism 10 is shown in FIG. 9. As is described in greater detail below, such embodiment is capable of independently advancing and retarding the time of valve opening. It includes a valve 29, a follower 27, a cam 21 with a lobe high point 22 and first and second control inserts 63, 65, respectively. The cam-contacting face 17 is atop insert 65 and the reference plane 15 is generally normal thereto and includes the axis of rotation 19 of the cam 21.

The insert 63 includes a first control surface 67 and insert 65 includes a second control surface 69. Each control surface 67, 69 includes an upper boundary 31 and a lower boundary 33 and as will become apparent, the boundaries 31, 33 are maintained to the left side of plane 15. Each insert 63, 65 is separately controlled by its own "dedicated" control mechanism, namely first mechanism 71 and second mechanism 73, respectively.

In normal operation, the insert 65 is positioned leftward so that its left end having surface 69 fits into the space 77 adjacent insert 63. To advance the opening time of the valve 29, both inserts 63, 65 are moved rightward until the lobe 25 contacts the surface 67 during a portion of each revolution of the cam 21. To retard the opening time of the valve 29, the insert 63 is positioned leftward approximately as shown in FIG. 9. The insert 65 is separated from insert 63 to a position such that the lobe 25 contacts the surface 69 during a portion of each revolution of the cam 21.

Irrespective of whether the timing of valve opening is being advanced or retarded, the lobe 25 also contacts surface 17 during at least a portion of each revolution of the cam 21. Therefore, the dimension to which the valve 29 is opened is not increased beyond normal.

Referring again to FIGS. 1–2, the insert 11 may be biased to the left and urged to the right by an opposing control force (as provided by control mechanism 59) to effect advances in valve timing. In event of a failure involving the mechanism 59 used to provide the control force, the insert 11 moves to a "neutral" position and normal valve timing is retained.

With the arrangement of FIGS. 3 and 4, the follower 27 may be biased to the left and an opposing control force urges such follower 27 to the right to retard valve timing. In event of a failure involving the mechanism 59 used to provide control force, the follower 27 moves to an extreme left or neutral position and normal valve timing results.

In the arrangement shown in FIG. 5, the follower 27 is biased to a neutral position whereby the cam 21 is generally midway between the depression 49 and the raised insert 11. Opposing control forces urge the follower 27 to the left or right for retarding or advancing valve timing, respectively. As in the arrangements above, a failure involving the mechanism 59 providing the control force causes the follower 27 to move to the neutral position.

In the arrangement shown in FIG. 6, the inserts 55, 57 (or composite insert, as the case may be) are biased to positions so that the lobe 25 only contacts the face 17. These are referred to as the neutral positions. Opposing control forces move the inserts 55, 57 for controlling valve timing but in the event of a failure of the control mechanism 59, the inserts 55, 57 move to neutral positions.

In the arrangement of FIG. 9, in normal operation the inserts 63, 65 are biased leftward to neutral positions so that the lobe 25 only contacts the face 17. Opposing control forces move the inserts 63, 65 for controlling valve timing but in the event of a failure of the mechanisms 71, 73, the inserts 63, 65 move to neutral positions.

The foregoing arrangements may be said to be "fail safe" in that the component(s) having the control surface(s) 23, 23*a*, 23*b*, 67, 69 formed thereon moves to the neutral position in event of a particular failure. In such neutral position, normal valve timing is provided. It is to be appreciated that the biasing mechanism may be a separate aspect of the control mechanism 59, 71 or 73.

In all of the embodiments, the insert 11 or follower 27 (as the case may be) and parts of the mechanism 59 may be required to move quickly into or out of a particular timing-controlling position. Therefore, in a highly preferred embodiment, such insert 11 or follower 27 and those parts of the mechanisms 59, 71, 73 which move for timing control are made of a metal composite material having a weight per unit volume significantly less than that of steel. The mass thereof is thus reduced and this lowers inertia and provides faster response with less control force. Suitable metal composite materials include aluminum or magnesium embedded with silicon carbide or silicon nitride fibers or particles. Such metal composite materials have physical properties similar to those of steel but for parts of equivalent size and shape, have significantly reduced mass.

While the principles of this invention have been described in connection with specific embodiments, it should be understood clearly that these descriptions are made only by way of example and are not intended to limit the scope of the invention.

I claim:

1. In an engine valve operating mechanism having a cam with a rotational axis and a lobe high point, a movable control surface and a cam follower, the improvement wherein:

such follower has a cam-contacting face and such surface is defined by boundaries maintained to one side of a plane generally normal to the face and which includes the axis; and, the control surface is on an insert mounted for movement on the cam follower, whereby movement of such insert varies the time of valve opening without increasing the dimension to which such valve is opened.

2. The mechanism of claim 1 wherein the time of valve opening may be advanced.

3. The mechanism of claim 1 wherein such insert is made of a metal composite material having a weight per unit volume significantly less than that of steel whereby the mass of such insert is reduced.

4. The mechanism of claim 1 wherein the time of valve opening may be retarded.

5. The mechanism of claim 1 wherein such insert is mounted for movement toward and away from such cam, wherein such insert is biased away from such cam and wherein such insert moves away from such cam in the absence of an opposing control force whereby such mechanism is made fail-safe.

6. The mechanism of claim 1 further including a second movable control surface whereby the time of such valve opening may be advanced or retarded.

* * * * *